US011486389B2

(12) United States Patent
Bierod et al.

(10) Patent No.: US 11,486,389 B2
(45) Date of Patent: Nov. 1, 2022

(54) HYDRAULIC UNIT

(71) Applicant: Robert Bosch GmbH, Stuttgart (DE)

(72) Inventors: Jan Lukas Bierod, Bad Camberg (DE); Andreas Guender, Ramsthal (DE); Marco Scholz, Burgsinn (DE); Ralf Maier, Neuendorf (DE); Rene Huettl, Chemnitz (DE); Stefan-Georg Backhaus, Partenstein (DE)

(73) Assignee: Robert Bosch GmbH, Stuttgart (DE)

( * ) Notice: Subject to any disclaimer, the term of this patent is extended or adjusted under 35 U.S.C. 154(b) by 309 days.

(21) Appl. No.: 16/654,137

(22) Filed: Oct. 16, 2019

(65) Prior Publication Data

US 2020/0124044 A1 Apr. 23, 2020

(30) Foreign Application Priority Data

Oct. 19, 2018 (DE) ..... 10 2018 217 927.1

(51) Int. Cl.

| | |
|---|---|
| ***F04B 53/16*** | (2006.01) |
| ***F04B 17/03*** | (2006.01) |
| ***F04B 1/2064*** | (2020.01) |
| ***F04B 53/00*** | (2006.01) |

(52) U.S. Cl.

CPC ..... *F04B 53/16* (2013.01); *F04B 1/2064* (2013.01); *F04B 17/03* (2013.01); *F04B 53/003* (2013.01)

(58) Field of Classification Search

CPC ..... F04B 1/145; F04B 1/2064; F04B 17/03; F04B 39/0044; F04B 53/003; F04B 53/16; F04D 29/606

See application file for complete search history.

(56) References Cited

U.S. PATENT DOCUMENTS

| | | | | |
|---|---|---|---|---|
| 5,332,371 | A * | 7/1994 | Dantlgraber | F04B 1/2014 417/271 |
| 2003/0003853 | A1* | 1/2003 | Stocker | B24B 9/065 451/57 |
| 2021/0164454 | A1* | 6/2021 | Chen | F04B 53/144 |

FOREIGN PATENT DOCUMENTS

| | | |
|---|---|---|
| DE | 44 16 449 A1 | 11/1995 |
| DE | 196 22 039 A1 | 12/1997 |

OTHER PUBLICATIONS

Nan et al., CN107228072A_Mach_Translation, 2017 (Year: 2017).*
Der Hydraulik Trainer, vol. 1, p. 296, 1991, published by Mannesmann Rexroth GmbH, accompanied by English language machine translation of p. 296.

* cited by examiner

*Primary Examiner* — Kenneth J Hansen
(74) *Attorney, Agent, or Firm* — Maginot, Moore & Beck LLP

(57) ABSTRACT

A hydraulic unit includes an assembly with a hydrostatic positive displacement pump and an electric motor. The positive displacement pump includes a driving shaft configured to be driven by the electric motor. The hydraulic unit also includes an inert mass on which the assembly is rigidly mounted so as to minimize vibration of the assembly and reduce noise emission from the assembly.

10 Claims, 1 Drawing Sheet

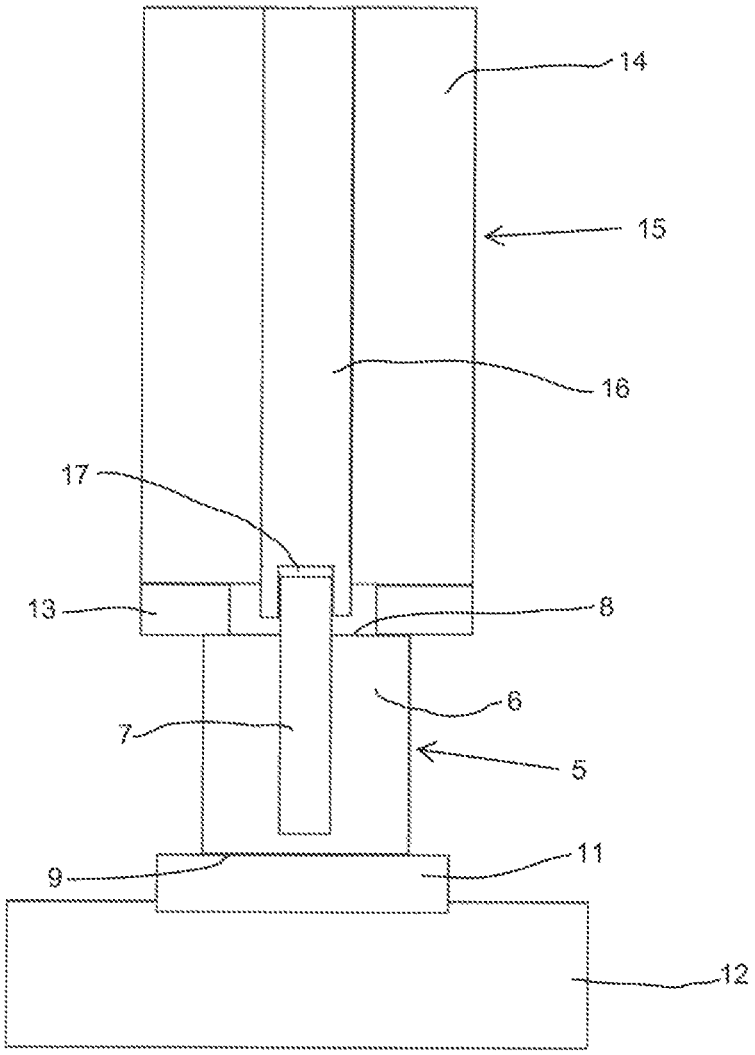
14
15
16
17
13
8
6
7
5
9
11
12

HYDRAULIC UNIT

This application claims priority under 35 U.S.C. § 119 to patent application no. DE 10 2018 217 927.1, filed on Oct. 19, 2018 in Germany, the disclosure of which is incorporated herein by reference in its entirety.

BACKGROUND

The disclosure relates to a hydraulic unit which comprises an assembly having a hydrostatic positive displacement pump and having an electric motor, by which a driving shaft of the positive displacement pump can be driven.

The book "Der Hydraulik Trainer", volume 1, page 296, 1991, published by Mannesmann Rexroth GmbH, discloses a hydraulic unit having a hydrostatic positive displacement pump and an electric motor, wherein the housing of the positive displacement pump is mounted on a pump support with the interposition of structure-borne sound insulating material. The electric motor is rigidly mounted on the pump support. The structure-borne sound insulating material between the housing of the positive displacement pump and the pump support is a profile rubber ring, which is pressed onto an annular projection of the pump support directed radially inward with an externally surrounding annular groove. Moreover, it is clamped axially between a clamping ring and a flange, which are connected to one another with screws. The housing of the positive displacement pump is mounted on the flange on the front side.

The pump support has a pump support foot with it is possibly mounted on a base using damping rails. The pump shaft and the motor shaft are connected to one another via a rotationally elastic coupling, such that there is no longer a metallic connection between the positive displacement pump and the electric motor.

DE 44 16 449 A1 discloses a hydraulic unit comprising a hydrostatic positive displacement machine and an electric motor, in which a pump support surrounds the positive displacement pump in a pot-shaped manner and has an outer flange on its open side, on which outer flange the electric motor is mounted. A clearance between the pump support and the housing of the positive displacement pump is filled with structure-borne sound insulating, rubbery material, on top of which the positive displacement pump is supported on the pump support. The pump support consists of polymer concrete. The pump shaft of the positive displacement pump and the motor shaft of the electric motor are connected to one another via a rotationally elastic coupling.

DE 196 22 039 A1 discloses a hydrostatic positive displacement pump, wherein in the sense of a simple production the metallic housing of a positive displacement pump, which has the usual storage and sealing functions, is directly surrounded by a sound insulation block, consisting of polymer concrete, at least in the region running parallel to the pump shaft.

The disclosure is based on the object of developing a hydraulic unit which comprises an assembly having a hydrostatic positive displacement pump and having an electric motor, by which a driving shaft of the positive displacement pump can be driven, in such a manner that the individual components are burdened by vibrations no more than to a minimum extent, that it emits little noise and that it can easily be produced in a cost-effective manner.

SUMMARY

This object is achieved in the case of a hydraulic unit, which an assembly having a hydrostatic positive displacement pump and having an electric motor, by which a pump shaft of the positive displacement pump can be driven, by additionally an inert mass being available, on which the assembly comprising the positive displacement pump and the electric motor is rigidly mounted.

A hydraulic unit according to the disclosure is characterized in the case of low complexity by low vibrations and a low noise emission. The low complexity results in low production costs. The natural vibration of the motor pump assembly is reduced as a result of the mounting on an inert mass. Vibrations thus only occur to a limited extent and are passively damped.

Even if reference is made here and below to a positive displacement pump and to an electric motor, this should not exclude the positive displacement pump operating as a hydro motor and the electric motor operating as a generator in certain operating conditions and electrical energy being recovered in these operating conditions.

In an advantageous embodiment of a hydraulic unit according to the disclosure, the pump is rigidly mounted on the inert mass and supports the electric motor.

The positive displacement pump usually has a pump housing having a first front side, on which a pump shaft is accessible for coupling with a motor shaft of the electric motor, and a second front side which is opposite. Preferably, the pump housing is rigidly connected to the inert mass on the second front side.

There are positive displacement pumps which are provided for a so-called through drive. In this case, the pump housing is not just provided centrally with an opening and with a mounting flange on the first front side for a passage of a shaft, but rather also on the second front side. Thus, a further positive displacement pump can be flange-mounted onto the first positive displacement pump on the second front side and be driven by the same motor as the first pump. It now appears advantageous, for the rigid mounting of a positive displacement pump on the inert mass, to take a pump with through drive and to use the mounting flange on the second front side for the rigid connection of the pump to the inert mass. The central opening on the second front side can be sealed by the inert mass or a separate pressure-tight cover. The second front side of a pump housing is usually formed on a housing part designated as connection plate. If it makes economic sense, a connection plate, which is not provided for a through drive, can also be equipped with means, for example with a mounting flange, for mounting on the inert mass.

The pump housing can also be rigidly mounted on the second front side on the inert mass via an intermediate plate, wherein it enables the intermediate plate to provide screw holes outside of the contour of the pump housing and thus to be able to use long screws for the mounting.

The positive displacement pump is preferably mounted in the vertical direction on the inert mass, such that a tilting moment does not act on the pump/inert mass connection.

It is also conceivable that the positive displacement pump and the electric motor are mounted on a pump support and that the pump support is rigidly mounted on the inert mass.

The positive displacement pump, more precisely a housing of the positive displacement pump, is preferably rigidly connected to a housing of the electric motor. In this way, the vibration damping as a result of the inert mass also has an impact on the electric motor, such that the latter is vibration-cushioned. This also applies if the housing of the positive displacement pump and the housing of the electric motor are rigidly connected to one another via an intermediate plate.

Advantageously, the pump shaft of the positive displacement pump and a motor shaft of the electric motor are rigidly connected to one another. Overall, in the case of a rigid mechanical connection between the housings and the shafts of the positive displacement pump and electric motor, complicated coupling components are not required, thus saving costs. Moreover, in comparison to motor pump units having an elastic connection between the pump and motor, the overall length is reduced. In the case of a reduced length of the assembly, vibrations and sound waves do not propagate as well. Long assemblies have a tendency to vibrate and can even amplify vibrations which occur depending on the natural frequency.

The pump shaft of the positive displacement pump and the motor shaft of the electric motor can be fitted into one another in order to be rigidly coupled to one another.

The inert mass is preferably produced from polymer concrete. Polymer concrete damps vibrations substantially more than cast iron.

BRIEF DESCRIPTION OF THE DRAWING

An exemplary embodiment of a hydraulic unit according to the disclosure, in which the pump shaft and the motor shaft are directly fitted into one another, is illustrated in the drawing. The disclosure is now explained in more detail with reference to this drawing.

DETAILED DESCRIPTION

In accordance with the drawing, a hydrostatic positive displacement pump 5, for example an axial piston pump or a gear pump, has a pump housing 6 and a pump shaft 7 rotatably mounted in the pump housing. The pump housing 6 has a first front side 8 and a second front side 9 in the direction of the pump shaft 7. The positive displacement pump 5 is fixedly connected to an intermediate plate 11 on this front side 9 and mounted on an inert mass 12 via the intermediate plate 11. The inert mass 12 is a solid body and consists in particular of polymer concrete, concrete or a metallic structure.

The positive displacement pump 5 is fixedly connected to an intermediate plate 13 on the front side 8, on which an electric motor 15 formed in particular as a servomotor or asynchronous motor is mounted with its housing 14. Overall, a first intermediate plate, a positive displacement pump, a second intermediate plate and an electric motor are therefore arranged in the vertical direction one above another on the inert mass 12 as main body. The intermediate plate 11 is screwed to the positive displacement pump 5 and outside of its contour to the inert mass 12. The intermediate plate 13 is likewise screwed to the positive displacement pump 5 and outside of its contour to the electric motor 15. The intermediate plates are a type of adapter, which facilitate screwing of the parts to each other, even when the screw holes of the parts have different distances from a central axis of the hydraulic unit.

If the positive displacement pump 5 is formed with mounting flanges which match the screw holes of the other parts, the intermediate plates can be dispensed with. This then results in a particularly low overall length of a hydraulic unit according to the disclosure.

As a result of the inert mass, the natural vibrations of the assembly comprising the positive displacement pump 5 and the electric motor 15 are reduced. Vibrations thus only occur to a limited extent and are passively damped.

In the highly schematic illustration according to the drawing, outside of the pump shaft 7 of the positive displacement pump 10, a motor shaft 16 of the electric motor 15 can also be identified. A recess 17, into which the pump shaft 7 is immersed, is introduced into the motor shaft 16 from its front side facing the pump shaft 7. Within the recess 17, the pump shaft 7 and the motor shaft 16 are coupled to one another in a manner secured against rotation, for example by an internal toothing of the motor shaft in the recess and an external toothing of the pump shaft or using a fitting groove and a feather key. The direct coupling of the pump shaft and motor shaft without a shaft coupling as an additional component contributes to the hydraulic unit being able to be constructed short in the axial direction, i.e. in the direction of the axes of the shafts 7 and 16. The tendency of the assembly to vibrate is reduced as a result of a short overall length.

Overall, a hydraulic unit is thus disclosed, which emits little noise, has a compact design and is constructed in a straightforward manner. As a result of avoiding complex components such as for example coupling housings with coupling and elastic intermediate layers to prevent the transfer of vibrations, production costs are low, as the costs for parts are eliminated and the installation time is reduced.

Furthermore, in the case of a hydraulic unit according to the disclosure, the motor pump assembly can be equipped with special lifting devices, in order to change the unit as a whole, such that downtimes are cut and the installation time is reduced.

REFERENCE LIST

5 positive displacement pump
6 pump housing
7 pump shaft
8 front side of 6
9 front side of 6
11 intermediate plate
12 inert mass
13 intermediate plate
14 housing of 15
15 electric motor
16 motor shaft
17 recess in 16

What is claimed is:

1. A hydraulic unit, comprising:

an assembly that includes a hydrostatic positive displacement pump and an electric motor having a motor shaft, the positive displacement pump including a pump shaft fixedly connected to the motor shaft such that the pump shaft is driven in rotation by the electric motor; and an inert mass on which the assembly is rigidly mounted, wherein the positive displacement pump is rigidly mounted on the inert mass and the electric motor is supported by the positive displacement pump, and wherein the inert mass is formed as a solid body of polymer concrete.

2. The hydraulic unit according to claim 1, wherein the positive displacement pump has a pump housing with (i) a first front side on which the pump shaft is accessible and configured to couple with the motor shaft of the electric motor and (ii) a second front side, which is opposite the first front side, on which the pump housing is rigidly connected to the inert mass.

3. The hydraulic unit according to claim 2, wherein the pump housing has a mounting flange on the second front side, the mounting flange directly rigidly mounted on the inert mass.

4. The hydraulic unit according to claim 2, wherein the pump housing is rigidly mounted on the second front side on the inert mass via an intermediate plate.

5. The hydraulic unit according to claim 1, wherein the positive displacement pump is mounted in a vertical direction on the inert mass.

6. The hydraulic unit according to claim 1, wherein the positive displacement pump and the electric motor are mounted on a pump support that is rigidly mounted on the inert mass.

7. The hydraulic unit according to claim 1, wherein the positive displacement pump has a pump housing that is rigidly connected to a housing of the electric motor.

8. The hydraulic unit according claim 7, wherein the pump housing and the housing of the electric motor are rigidly connected to one another via an intermediate plate.

9. The hydraulic unit according to claim 1, wherein the pump shaft and the motor shaft of the electric motor are fitted into one another.

10. The hydraulic unit according to claim 1, wherein the positive displacement pump is rigidly mounted on the inert mass without coupling housings having coupling or elastic intermediate layers.

* * * * *